US006705071B2

(12) United States Patent
Kataoka

(10) Patent No.: US 6,705,071 B2
(45) Date of Patent: Mar. 16, 2004

(54) FALSE-TWIST TEXTURING METHOD

(75) Inventor: Shigenori Kataoka, Osaka (JP)

(73) Assignee: Murata Kikai Kabushiki Kaisha, Kyota (JP)

( * ) Notice: Subject to any disclaimer, the term of this patent is extended or adjusted under 35 U.S.C. 154(b) by 177 days.

(21) Appl. No.: 09/989,184

(22) Filed: Nov. 21, 2001

(65) Prior Publication Data

US 2002/0139104 A1 Oct. 3, 2002

(30) Foreign Application Priority Data

Feb. 20, 2001 (JP) ..... 2001-042720

(51) Int. Cl.[7] ..... D02G 3/02
(52) U.S. Cl. ..... 57/284; 57/332; 57/336
(58) Field of Search ..... 57/282, 283, 284, 57/285, 286, 287, 288, 289, 290, 291, 292, 332, 333, 334, 335, 336, 337, 338, 339, 340, 341, 342, 343, 344, 345, 346, 347, 348, 349

(56) References Cited

U.S. PATENT DOCUMENTS 4,362,011 A * 12/1982 Kikuchi ..... 57/291
2003/0054718 A1 * 3/2003 Ochi et al. ..... 442/182
2003/0079297 A1 * 5/2003 Yamakita ..... 8/115.51

FOREIGN PATENT DOCUMENTS

EP 1283285 A2 * 2/2003 ..... D01F/6/62
JP 2000226746 A * 8/2000 ..... D02G/3/02
JP 2001-49542 2/2001
JP 2001295164 A * 10/2001 ..... D04B/1/16
JP 2002165721 A * 6/2002 ..... A47K/7/02

OTHER PUBLICATIONS

Kanebo, Ltd; www.kanebotx.com (Nov. 19, 2000) pp. 1–4.*

* cited by examiner

*Primary Examiner*—John J. Calvert
*Assistant Examiner*—Shaun R Hurley
(74) *Attorney, Agent, or Firm*—Westerman Hattori Daniels & Adrian LLP

(57) ABSTRACT

According to the false-twist texturing method of the yarn including poly lactic acid fiber, the false-twisting device 8 is made to be a nip typed false-twisting device and the heating temperature by the first heater 5 is made to be lower than or equal to 130° C. The false-twist texturing method of the present invention is capable of eliminating the yarn breakage of the poly lactic acid fiber which is weak against the friction and the heat, due to the twisting by the false-twisting device and the heating by the first heater.

5 Claims, 1 Drawing Sheet

FIGURE
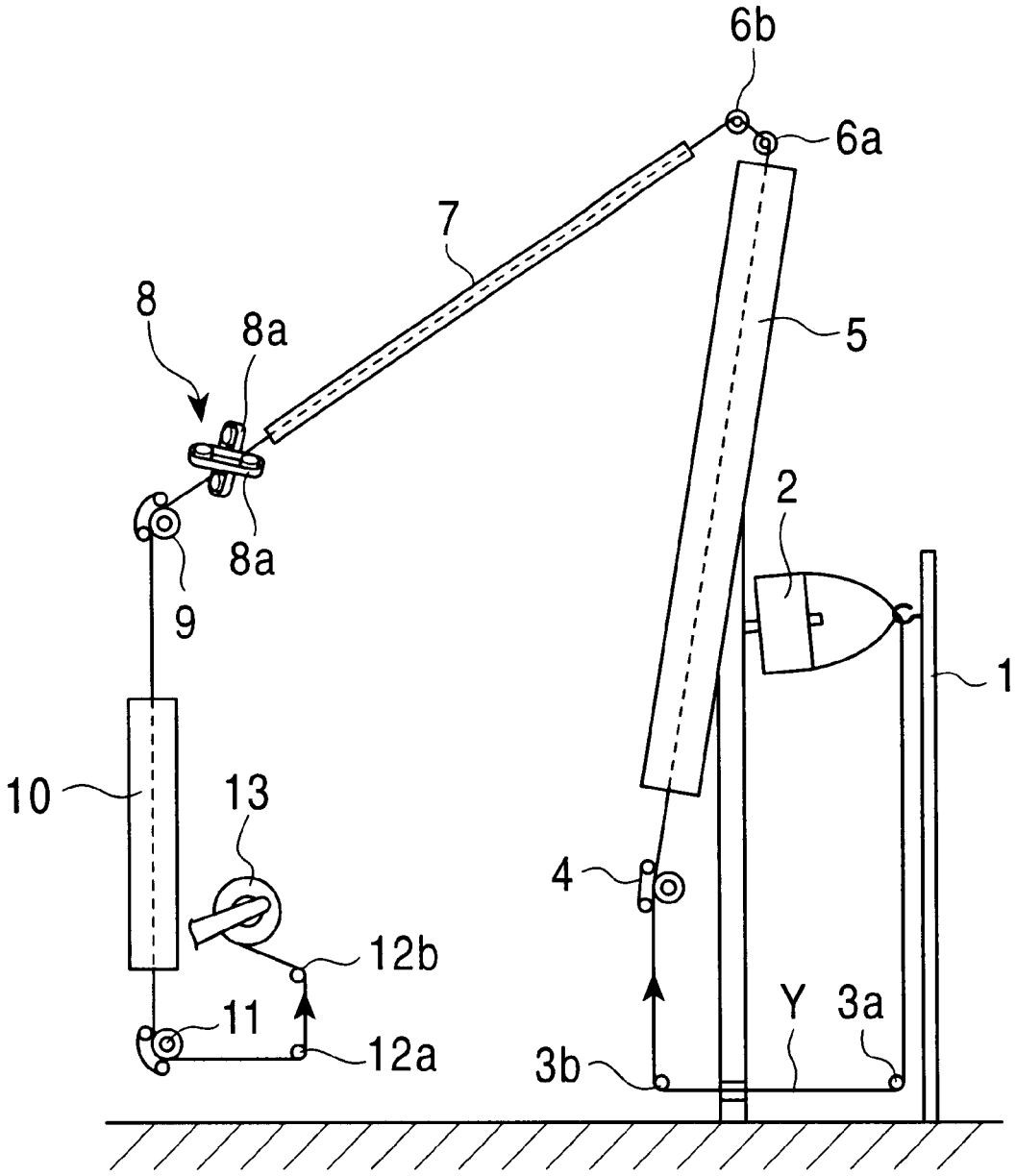

FALSE-TWIST TEXTURING METHOD

FIELD OF THE INVENTION

The present invention relates to a false-twist texturing method of a yarn including poly lactic acid fiber (PLA) which is manufactured from poly lactic resin of which the raw material is the lactic acid obtained from starch of the corn or the like.

BACKGROUND OF THE INVENTION

Conventionally, a false-twist texturing method wherein synthetic fiber filament yarn of polyester yarn or the like unwound from a yarn supplying package is inserted through a first heater which is heated more than or equal to approximately 120° C., false-twisted by a friction typed false-twisting device provided in the downstream side to the first heater, and then after inserted through a second heater for reducing a yarn torque, wound into a package via an oiling device or the like accordingly, is known.

Recently, from the aspect of the environment, a yarn of which the raw material is the poly lactic acid fiber has been paid attention and such yarn has been attempted to be textured with a false-twist.

However, the poly lactic acid fiber is weak against heat and friction, and the elasticity and the strength is also low. Therefore, when false-twist texturing is carried out to such fiber under the same conventional condition, there was a problem in that a yarn breakage occurred frequently.

It is thus the object of the present invention to provide a false-twist texturing method capable of applying false-twist texturing to the yarn including at least the poly lactic acid fiber without causing the yarn breakage frequently.

SUMMARY OF THE INVENTION

To accomplish the object mentioned above, a false-twist texturing method of the present invention is characterized in that a yarn including the poly lactic acid fiber is fed through a first feed roller, a first heater, a false-twisting device and a second feed roller in this order, and the yarn is to be textured with false-twist under the condition in which the heating temperature of the first heater is set lower than or equal to 130° C. According to the false-twist texturing method, it is preferable to set the heating temperature of the first heater to be lower than or equal to 110° C. Moreover, the first heater is preferable to be a contacting typed heater comprising a heat plate where the running yarn contacts. In addition, the contacting length of the yarn to the contacting typed heater is preferable to be shorter than or equal to two meters.

Moreover, the false-twisting device is preferable to be a nip typed false-twisting device. Furthermore, a balloon control plate is to be provided between the first heater and the false-twisting device, and a yarn guide is to be provided between the balloon control plate and the first heater, and it is preferable to bend the yarn by the yarn guide. In addition, a plurality of yarn guides are to be provided, and the yarn guide located at the first heater side among the plurality of yarn guides is preferable to be a rotatable yarn guide.

BRIEF DESCRIPTION OF THE DRAWINGS

FIG. 1 is a side view of the false-twist texturing machine as an example to be applied with the false-twist texturing method of the present invention.

DETAILED DESCRIPTION OF THE PREFERRED EMBODIMENTS

An embodiment of the present invention will be described in the followings, however, it is not to be limited to the embodiment unless it exceeds the purpose of the present invention.

In FIG. 1, 1 is a creel stand which is supporting a yarn supplying package 2. A filament yarn Y unwound from the yarn supplying package 2, including at least the poly lactic acid fiber (hereafter simply referred to as the "yarn". Further, in the present embodiment, the yarn comprised of 100% poly lactic acid fiber will be used), reaches a first feed roller 4 via yarn guides 3*a*, 3*b* appropriately. The yarn Y fed by the first feed roller 4 under a designated speed, is inserted through a first heater 5 provided approximately vertically, and then after passing through yarn guides 6*a*, 6*b*, the yarn Y is fed through a balloon control plate 7 and applied with false-twist by a nip typed false-twisting device 8 comprised of a pair of endless belts 8*a* intersecting with one another. The balloon control plate 7 is constructed so that the sectional shape perpendicular in the longitudinal direction forms the shape of approximately letter V reversed, prevents the generation of the ballooning of the yarn Y, and includes a function for cooling down the yarn Y. The yarn Y applied with a false-twist by the nip typed false-twisting device 8 is inserted through a second heater 10 of which the heating temperature is equal to or lower than the heating temperature of the first heater 5, via a second feed roller 9, and after the torque is reduced, the yarn Y is passed through a third feed roller 11 and yarn guides 12*a*, 12*b* to be wound into a winding package 13.

According to the present embodiment, the first heater 5 is constructed as a contacting typed heater adopting Dowtherm vapor, and the heating temperature is to be lower than or equal to 130° C., preferable to be lower than or equal to 110° C. The yarn Y runs while contacting to the heating plate of the first heater 5 which is heated lower than or equal to 130° C., preferably to be lower than or equal to 110° C. As in the manner stated above, by setting the heating temperature to be lower than or equal to 130° C., preferably to be lower than or equal to 110° C., a yarn breakage due to the heating by the first heater 5 of the poly lactic acid fiber which is weak against heat can be eliminated. Moreover, the contacting length of the yarn Y is preferable to be shorter than or equal to two meters and by constructing in such manner, the generation of hairiness (filament breakage) can be prevented. In the case of a high-multi yarn which is lower than or equal to one denier per one filament, the heating temperature of the first heater 5 is preferable to be lower than or equal to 110° C.

Moreover, in place of the friction type false-twisting device wherein the yarn Y is false-twisted by being passed through a plurality of rotating disks in a zigzag for example, according to the embodiment of the present invention, the false-twisting device is made to be a nip typed false-twisting device 8 constructed of a pair of endless belts 8*a* intersecting with one another. Therefore, the yarn breakage due to the false-twisting by the friction typed false-twisting device of poly lactic acid fiber which is weak against friction can be eliminated.

Furthermore, according to the embodiment, the yarn guides 6*a*, 6*b* are provided between the first heater 5 provided approximately vertically, and the balloon control plate 7 inclining so that the downstream side becomes lower. The yarn guides 6*a*, 6*b* changes the direction of the yarn Y fed out from the first heater 5 toward the direction of the balloon control plate 7, and bends the yarn path. Moreover, the yarn guide 6*b* located in the balloon control plate 7 side is constructed as non-rotating fixed yarn guide, and the yarn guide 6*a* located in the first heater 5 side is constructed as a rotatable yarn guide.

As in the manner stated above, by bending the yarn Y by the yarn guides 6*a*, 6*b* provided between the first heater 5 and the balloon control plate 7, a moderate tension is applied to the yarn Y and the efficiency of the false-twisting by the nip typed false-twisting device 8 can be improved. In other words, when the yarn Y in the upstream side of the false-twisting device 8 is not to be bent, to raise the yarn tension in the upstream side of the false-twisting device 8, the drawing ratio between the first feed roller 4 and the second feed roller 9 is required to be raised. However, when constructed in such manner, the yarn breakage occurs frequently in poly lactic acid fiber which is low in elasticity. Therefore, as in the manner stated above, by having the yarn Y bent, the occurrence of the yarn breakage can be prevented and the efficiency of the false-twisting can be improved.

Moreover, among the yarn guides 6*a*, 6*b*, by constructing the yarn guide 6*a* located in the first heater 5 side as a rotatable yarn guide, the propagation of the twisting applied by the nip typed false-twisting device 8 toward the first heater 5 becomes satisfactory and the propagation of the twisting into the first heater 5 is to be carried out reliably. Therefore, the yarn breakage or the hairiness (filament breakage) due to the defect in the propagation of the twisting applied by the nip typed false-twisting device 8, can be eliminated. The yarn guide 6*a* of the first heater 5 side is made to be a rotating yarn guide, since the bending degree of the yarn Y at the yarn guide 6*a* is large. In the case the bending degree of the yarn Y at the yarn guide 6*b* is large, the yarn guide 6*b* can also be made as a rotating yarn guide.

Furthermore, according to the present embodiment, the ratio of the yarn feeding speed between the first feed roller 4 provided between the yarn supplying package 2 and the first heater 5, and the second feed roller 9 provided between the nip typed false-twisting device 8 and the second heater 10, is preferable to be made about 1.4 to 1.6, smaller than the conventional 1.6 to 1.9. According to such structure, even when the elasticity and the strength are low as the poly lactic acid fiber, the yarn breakage is prevented from occurring frequently.

The ratio of the yarn feeding speed is calculated by the following formula.

$$\text{The ratio of the yarn feeding speed} = \frac{\text{the yarn feeding speed of the second feed roller 9}}{\text{the yarn feeding speed of the first feed roller 4}}$$

Further, a non-contacting typed heater of heating the yarn Y with steam can be used as the first heater 5. Also in such case, the heating temperature is to be lower than or equal to 130° C., preferably to be lower than or equal to 110° C., for example, 80° C. Moreover, before the yarn Y is inserted through the first heater 5, water can be sprayed to the yarn Y by a spraying device, or water can be adhered to the yarn Y by being passed through a water tank. In such case, the first heater 5 is to be the non-contacting typed heater, and the heating temperature can be the temperature exceeding 130° C.

Since the present invention is constructed in the manner stated above, the following effects can be earned.

Since the false-twist texturing is applied to the yarn by passing the yarn including the poly lactic acid fiber through the first feed roller, the first heater, the false-twisting device and the second feed roller, in this order, and setting the heating temperature of the first heater to be lower than or equal to 130° C., preferably to be lower than or equal to 110° C., the yarn including the poly lactic acid fiber which is weak against the heat can be prevented from causing yarn breakage due to the heating of the first heater.

Furthermore, as a preferable embodiment, since the first heater is made to be the contacting-typed heater comprising the heat plate where the running yarn contacts, the occurrence of the yarn breakage can be prevented even more. In addition, as a preferable embodiment, since the contacting length of the yarn to the contacting typed heater is made shorter than or equal to two meters, the generation of the yarn breakage can be prevented even more.

Moreover, as a desirable embodiment, since the false-twisting devise is made to be a nip typed false-twisting device, the yarn comprising the poly lactic acid fiber which is weak against the friction can be prevented from causing the yarn breakage or the filament breakage due to the twisting by the false-twisting device.

Furthermore, as a desirable embodiment, since the balloon control plate is provided between the first heater and the false twisting device, and the yarn guide is provided between the balloon control plate and the first heater, and the yarn is made to bend by the yarn guide, an appropriate tension is applied to the yarn. As a result, the efficiency in the false-twisting by the nip typed false-twisting device is improved.

In addition, as a desirable embodiment, since a plurality of the yarn guides are provided, and the yarn guide located in the first heater side among the plurality of yarn guides is made to be a rotatable guide, the propagation of the twisting applied by the nip typed false-twisting device can be carried out reliably. As a result, the occurrence of the yarn breakage due to the defect in the propagation of the twisting false-twisted by the nip typed false-twisting device can be prevented.

What is claimed is:

1. A false-twist texturing method for applying false-twist texturing to a yarn comprising: providing a first heater which is a contacting type heater having a heat plate where the running yarn contacts, and wherein a contacting length of the yarn to the contracting type heater is shorter than or equal to two meters; feeding the yarn including poly lactic acid fiber through a first feed roller, the first heater, a false-twisting device, and a second feed roller accordingly; and setting a heating temperature of the first heater to be lower than or equal to 130°.

2. A false-twist texturing method according to claim 1 wherein the heating temperature of the first heater is to be lower than or equal to 110° C.

3. A false-twist texturing method according to claim 1 or claim 2 wherein the false-twisting device is a nip typed false-twisting device.

4. A false-twist texturing method according to claim 3 wherein a balloon control plate is provided between the first heater and the false-twisting device, a yarn guide is provided between the balloon control plate and the first heater, and the yarn is bent by the yarn guide.

5. A false-twist texturing method according to claim 3 wherein a balloon control plate is provided between the first heater and the false-twisting device, a plurality of yarn guides are provided between the balloon control plate and the first heater, the yarn is bent by the yarn guides, and the yarn guide which is located at the first heater side, among the plurality of yarn guides, is a rotatable yarn guide.

* * * * *